US006733316B1

(12) United States Patent
Chen

(10) Patent No.: US 6,733,316 B1
(45) Date of Patent: May 11, 2004

(54) LAMP SOCKET FOR HOLDING LAMP TUBE

(76) Inventor: Chuan-Ying Chen, PO Box 82-144, Taipei (TW)

( * ) Notice: Subject to any disclaimer, the term of this patent is extended or adjusted under 35 U.S.C. 154(b) by 52 days.

(21) Appl. No.: 10/428,773

(22) Filed: May 5, 2003

(51) Int. Cl.[7] ..... H01R 33/02
(52) U.S. Cl. ..... 439/232; 439/350; 439/441
(58) Field of Search ..... 439/232, 233, 439/646, 441, 834, 835, 356, 488, 491

(56) References Cited

U.S. PATENT DOCUMENTS 5,376,025 A * 12/1994 Willnat et al. ..... 439/817
5,855,487 A * 1/1999 Kunishi ..... 439/232
6,332,796 B1 * 12/2001 Chen ..... 439/226

* cited by examiner

*Primary Examiner*—Tho D. Ta
(74) *Attorney, Agent, or Firm*—Leong C. Lei

(57) ABSTRACT

A lamp socket for holding lamp tube is disclosed. The socket comprises a base seat with a front face having a cavity slot with an open end and the lateral walls of the cavity slot being an arch-shaped portion and a top end disposed with a sliding slot in communication therewith. Two conductive pegs are provided to the bottom edge of the arch-shaped portion and two wire securing conductive plates are connected to the conductive pegs. A panel is sued to cover the front face of the base seat and the body of the panel is provided with a guiding slot to parallel guide the sliding of the pins of the lamp tube. A lamp pin engaging device including an urging element, and having two lateral sides is provided with conductive copper plates. The center region of the engaging device is disposed with an interlining shaft which can be extended up and down. The urging motion of the interlinkig shaft will shift the urging plate to be at high or low position.

3 Claims, 6 Drawing Sheets

LAMP SOCKET FOR HOLDING LAMP TUBE

BACKGROUND OF THE INVENTION

1 Technical Field of the Invention

The present invention relates to a lamp socket, and in particular, to a lamp socket having the function of pre-investigating of module status with respect to abnormality and the function of restoring to normal operation condition. The lamp socket allows precise mounting of the fluorescent tube to provide rapid lighting.

2 Description of the Prior Art

Conventional types of lamp socket for holding lamp tube are of two types, i.e., the elastic support socket and the rotatably mounting socket. In the elastic support socket, an elastic insertion socket is in combination with a base seat, and the elastic insertion socket is compressible and restorable. The insertion socket is provided with conductive insertion holes for the insertion of the fluorescent tube tip. Thus, it provides support to the fluorescent tube and to electrically conduction of the fluorescent tube. However, after a period of use, the disassembly or installation of the tube is laborious and inconvenient. One hand is needed to hold the fluorescent tube and the other hand is used to mount the fluorescent tube onto the elastic insertion socket, so as to cause the fluorescent tube pins to be precisely inserted or removed. The use of both hands to complete the installation or disassemble is not only troublesome, but also a danger for the reason that the hand may accidentally touch the current and electrocuted.

The other type of rotating socket has a base seat combined with a rotating seat. The fluorescent tube pins are corresponding to conductive plates on the rotating socket. The tube is rotated to 90 degree so as to engage or contact with the conductive copper plate and to provide support and electrically conduction of the fluorescent tube. The rotating socket allows rapid assembly and/or disassembly, but to rotate for 90 degree of the fluorescent tube is not convenient.

Taiwanese Patent Application No. 89209682 entitled "socket structure for fluorescent tube" discloses a rapid socket which allows rapid mounting by a pressing method.

The socket structure allows rapid disassembly. However, it is not possible to determine the position of the conductive copper plates or to adjust or to restore the height of the conductive copper plates.

Accordingly, it is an object of the present invention to provide a lamp socket for holding a lamp tube.

SUMMARY OF THE INVENTION

It is an object of the present invention to provide a lamp structure for holding lamp tube comprising a base seat with a front face having a cavity slot with an open bottom end and the lateral walls of the cavity slot being an arch-shaped portion and a top end disposed with a sliding slot in communication therewith; and two conductive peg mounted at the bottom end of the arch-shaped portion of the cavity slot; two wire securing conductive plates having one end connected to the end terminal of the conductive peg and the other end being bent to allow the core of wire to be inserted to the elastic mounting section; a panel covered the front face of the base seat, the body of the panel provided with a guiding slot to parallel guide the sliding of the pins of the lamp tube, and a lamp pin engaging device including an urging element, and having two lateral sides provided with conductive copper plates to closely slide along the lateral walls of the cavity slot, and having a center region disposed with an inter-linking shaft which can be extended up and down, whereby the urging motion of the interlinking shaft shifting the urging plate to be at the high and low position within the cavity slot.

Yet another object of the present invention is to provide a lamp socket for holding lamp tube, wherein the interlinking shaft is provided with a color different from that of the base seat.

Still another object of the present invention is to provide a lamp socket for holding lamp tube, wherein the bottom edge of the interlinking shaft is extended to form a smaller diameter section such that when the urging plate is at a high position, the smaller diameter section is exactly exposed from the bottom face of the base seat.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1 to 4, there is shown a lamp structure for holding lamp tube comprising a base seat with a front face having a cavity slot with an open bottom end and the lateral walls of the cavity slot being an arch-shaped portion and a top end disposed with a sliding slot in communication therewith; and two conductive peg mounted at the bottom end of the arch-shaped portion of the cavity slot; two wire securing conductive plates having one end connected to the end terminal of the conductive peg and the other end being bent to allow the core of wire to be inserted to the elastic mounting section; a panel covered the front face of the base seat, the body of the panel provided with a guiding slot to parallel guide the sliding of the pins of the lamp tube, and a lamp pin engaging device including an urging element, and having two lateral sides provided with conductive copper plates to closely slide along the lateral walls of the cavity slot, and having a center region disposed with an inter-linking shaft which can be extended up and down, whereby the urging motion of the interlining shaft shifting the urging plate to be at the high and low position within the cavity slot.

Figure 1:
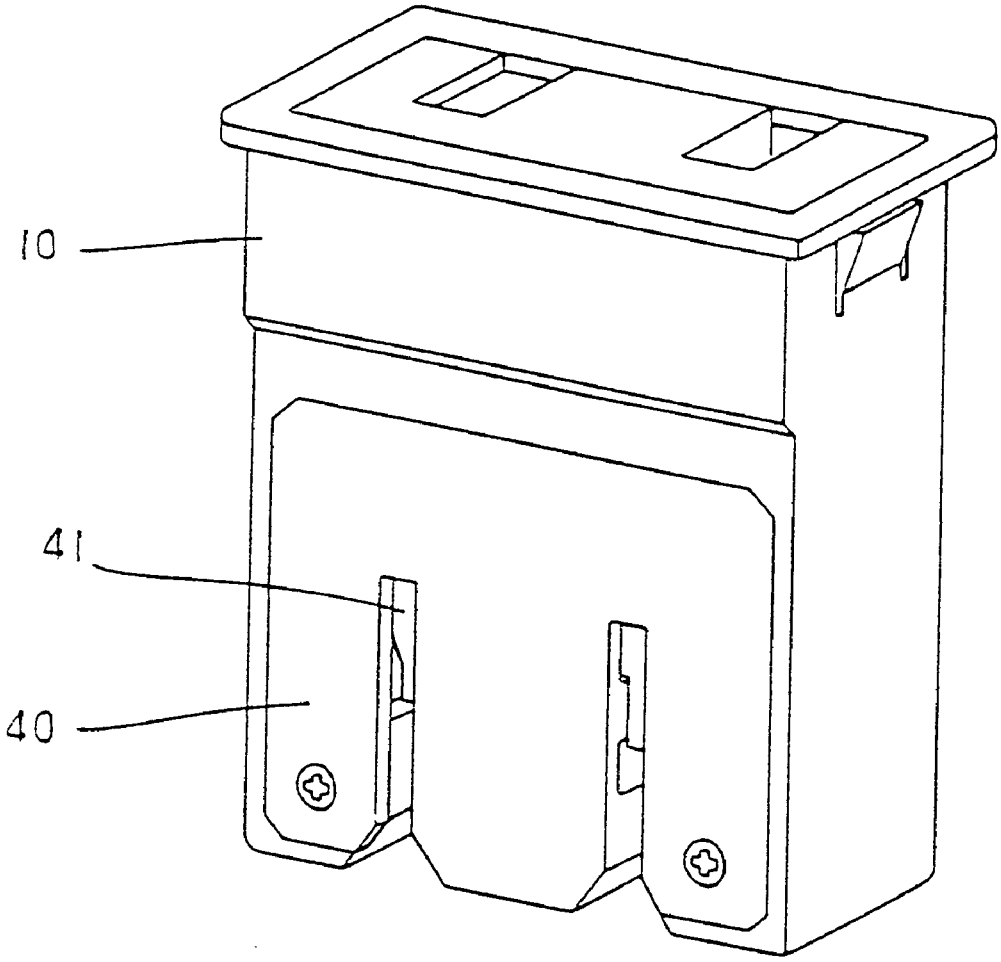
FIG. 1 is a perspective view of a lamp socket for holding lamp tube of the present invention.
Figure 2:
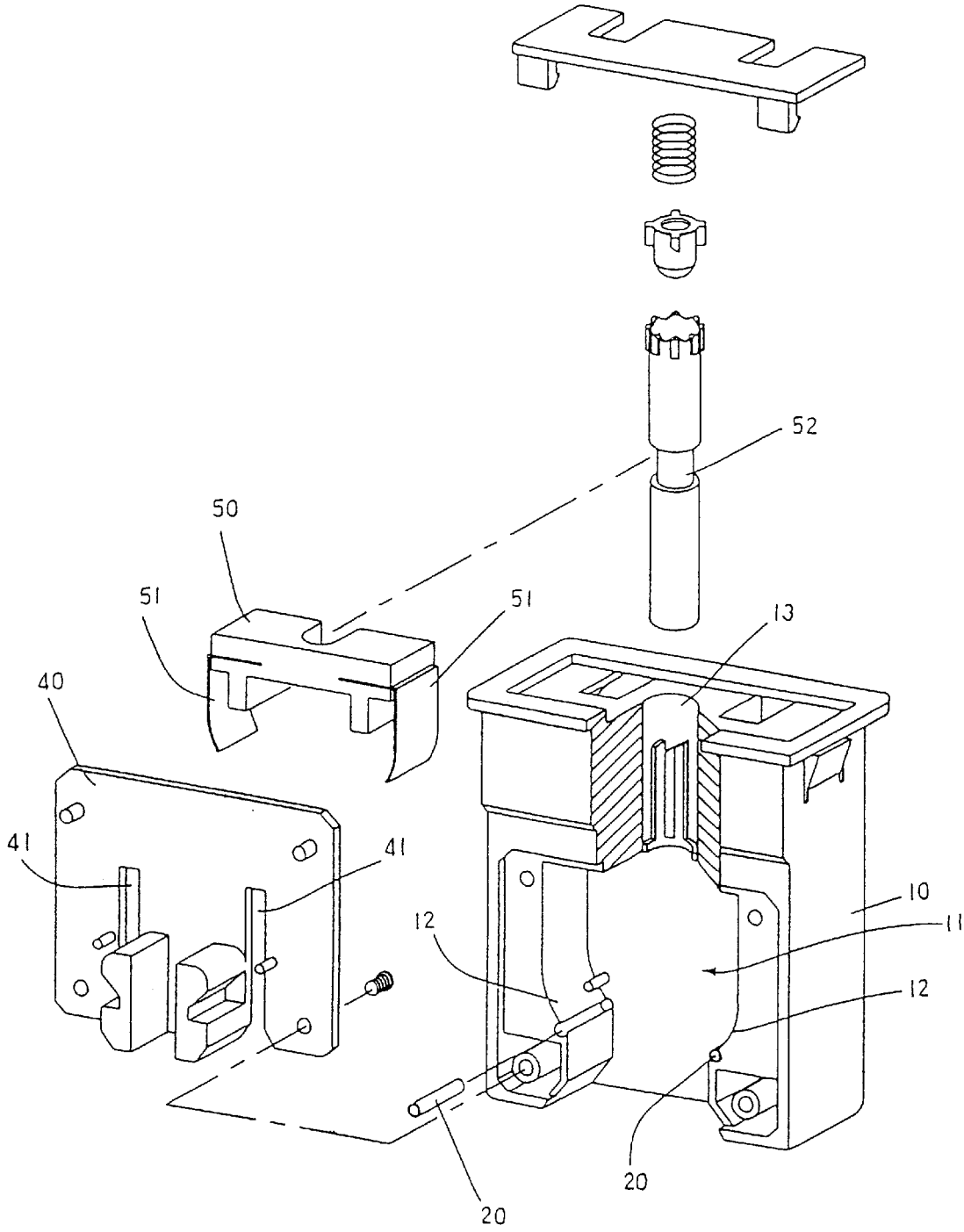
FIG. 2 is a perspective exploded view of a lamp socket for holding lamp tube of the present invention.
Figure 3:
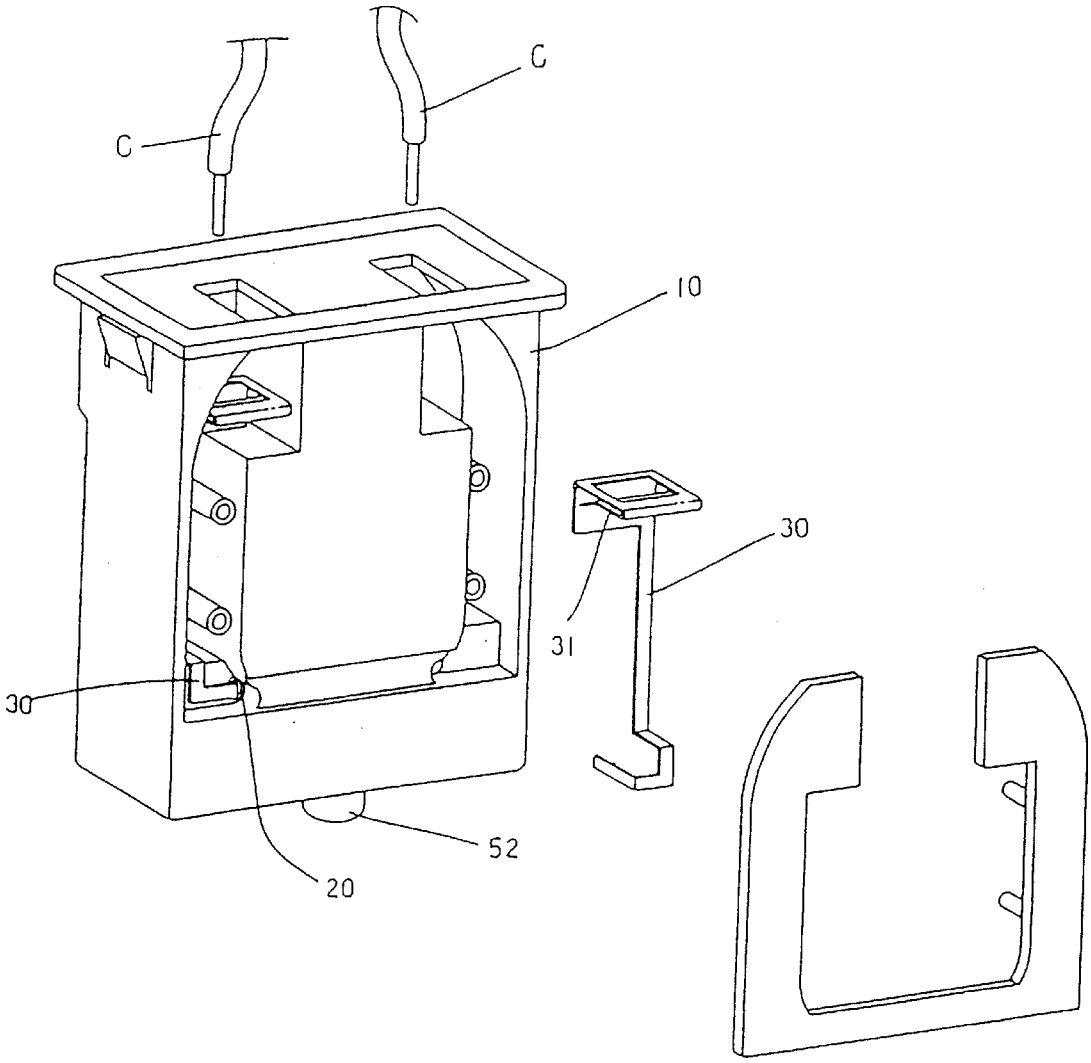
FIG. 3 is another perspective exploded view of a lamp socket for holding lamp tube of the present invention.
Figure 4:
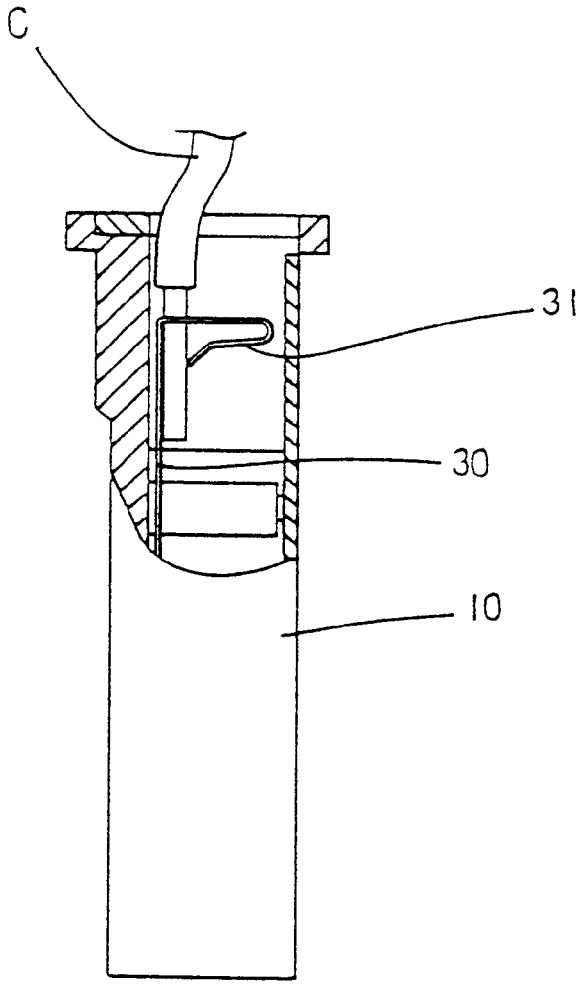
FIG. 4 is a schematic view showing the insertion of conductive wire into the lamp socket of the present invention.
Figure 5:
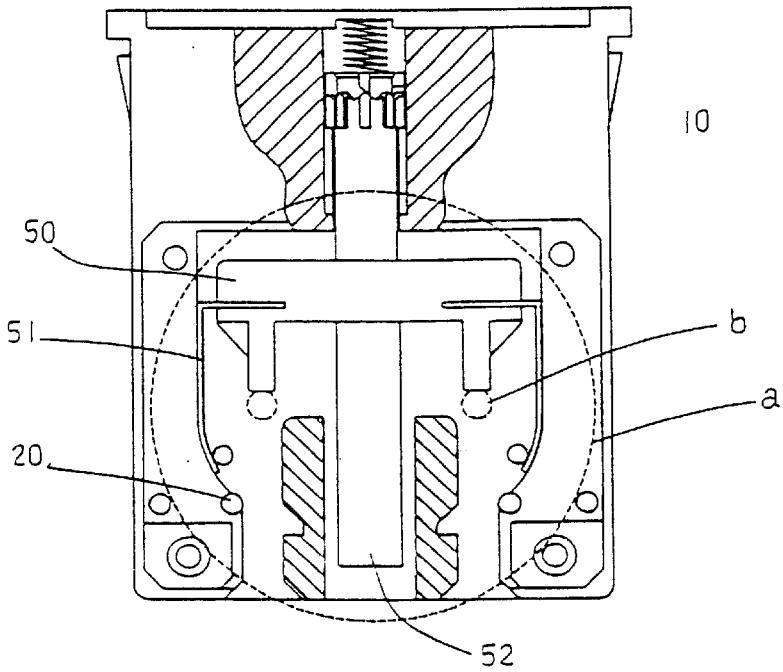
FIG. 5 is a schematic view showing the lamp socket prior to mounting of a fluorescent tube in accordance with the present invention.

As shown in FIGS. 4 and 5, prior to the mounting of a lamp tube to the socket of the present invention, the urging element 50 is engaged at the high position point and the bottom edge of the conductive copper plate 51 is higher than the conductive peg 20, such that the lamp pin b of the lamp tube a can be lifted up and down within the guiding slot 41 of the panel, and the interlinkig shaft 52 can be lifted up beyond the bottom edge of the shaft without exposing the bottom face of the base seat so as to represent that the conductive upper plate 51 is at a mounting status. When implementing, the panels 40 of the two sockets face each other and the long lamp tube is fixed to the lamp shaft. The cores of the positive and negative wires are inserted into the elastic fastening section 31 of the conductive plate.

Figure 6:
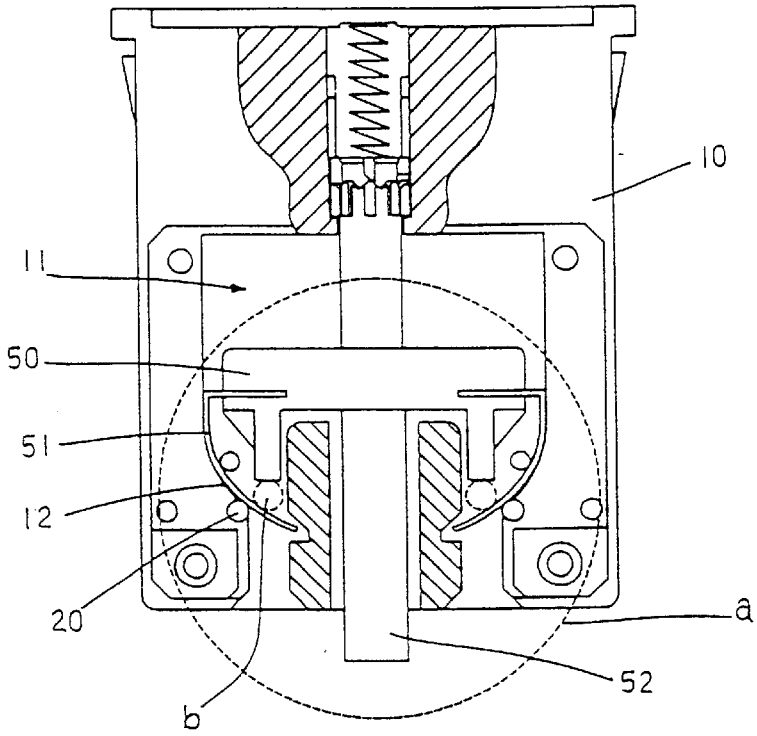
FIG. 6 is a schematic view showing the lamp socket after the mounting of a fluorescent tube in accordance with the present invention.

As shown in FIG. 6, if the bottom end of the interlinking shaft 52 is extended out the bottom face of the base seat 10, this can determine the conductive copper plate 51 is at low position point status. At this moment, the bottom end of the interlinking shaft 52 is pushed and pressed such that the urging element 50 switching the conductive copper plate 51 to adjust to a restore position so as to ensure the installation of the lamp tube (a) is normal.

Referring to FIGS. 5 and 6, the lamp pin b is guided in parallel along the guiding slot 41 and is pushed to the bottom and their released. The urging element 50 will be lowered together with the lamp pin b to the low position point so as to interlink the bottom end of the conductive copper plate 51 to earlier touching the conductive peg 20 to slide and block at the lower section of the lamp pin such that the lamp pin b is in conductive with the conductive copper plate 51. Thus the installation of lamp tube is completed. The lamp tube (a) is pushed up once, the urging element 50 interlinks the conductive copper plate 51, and the interlink shaft 52 is switched from the low position point to high position point, and therefore the lamp tube a can be removed.

Figure 7:
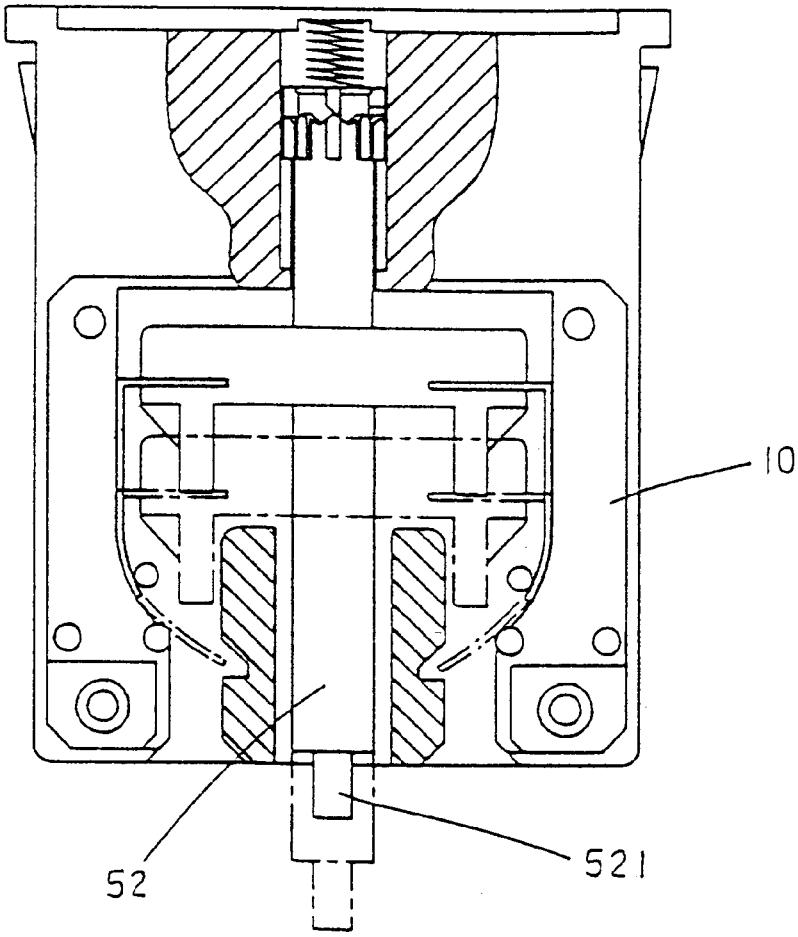
FIG. 7 is a schematic view showing the structure of the interlinking shaft in accordance with the present invention.

As shown in FIG. 7, the bottom end of the interlinking shaft 52 is extended to form a smaller diameter section 521 and when the urging element 50 is stopped at the high position point, the smaller diameter point section 521 will exactly expose beyond the bottom face of the base seat 10. This is an indication of urging element at high or low status. The interlinking shaft 52 is provided with a different color to the base seat 10 so as to provide a clear indication.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A lamp structure for holding lamp tube comprising:

(a) a base seat with a front face having a cavity slot with an open bottom end and the lateral walls of the cavity slot being an arch-shaped portion and a top end disposed with a sliding slot in communication therewith; and two conductive peg mounted at the bottom end of the arch-shaped portion of the cavity slot;

(b) two wire securing conductive plates having one end connected to the end terminal of the conductive peg and the other end being bent to allow the core of wire to be inserted to the elastic mounting section;

(c) a panel covered the front face of the base seat, the body of the panel provided with a guiding slot to parallel guide the sliding of the pins of the lamp tube, and (d) a lamp pin engaging device including an urging element, and having two lateral sides provided with conductive copper plates to closely slide along the lateral walls of the cavity slot, and having a center region disposed with an inter-linking shaft which can be extended up and down, whereby the urging motion of the interlinking shaft shifting the urging plate to be at the high and low position within the cavity slot.

2. A lamp structure for holding lamp tube of claim 1, wherein the interlining shaft is provided with a color different from that of the base seat.

3. A lamp structure for holding lamp tube of claim 1, wherein the bottom edge of the interlinking shaft is extended to form a smaller diameter section such that when the urging plate is at a high position, the smaller diameter section is exactly exposed from the bottom face of the base seat.

* * * * *